US006174198B1

(12) United States Patent
Wu et al.

(10) Patent No.: US 6,174,198 B1
(45) Date of Patent: Jan. 16, 2001

(54) ELECTRICAL CONNECTOR ASSEMBLY

(75) Inventors: Kun-Tsan Wu, Tu-Chen; Kuo-Hua Chih, Tao-Yuan; Jen-Jou Chang, Yung-Ho, all of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/374,880

(22) Filed: Aug. 13, 1999

Related U.S. Application Data

(63) Continuation-in-part of application No. 09/295,969, filed on Apr. 21, 1999.

(30) Foreign Application Priority Data

May 25, 1999 (TW) ..... 88208415

(51) Int. Cl.[7] ..... H01R 13/60
(52) U.S. Cl. ..... 439/541.5; 439/607; 439/941
(58) Field of Search ..... 439/667, 607, 439/541.5, 79, 490, 76.1, 941

(56) References Cited

U.S. PATENT DOCUMENTS 3,761,842 * 9/1973 Gandrud ..... 333/1
5,637,015 * 6/1997 Tan et al. ..... 439/607
5,759,067 * 6/1998 Scheer ..... 439/607
5,989,069 * 11/1999 Tan ..... 439/620
6,027,375 * 2/2000 Wu ..... 439/607
6,053,773 * 4/2000 Wu ..... 439/609

OTHER PUBLICATIONS

Big News! In Printed Circuit Connectors, Electronic Components News, Mar. 1954, H.H. Buggie, Inc.*

* cited by examiner

*Primary Examiner*—Brian Sircus
*Assistant Examiner*—P Dinh
(74) *Attorney, Agent, or Firm*—Wei Te Chung

(57) ABSTRACT

An electrical connector assembly comprises a first connector, a pair of second connectors, a circuit board and a bracket. The first connector includes a plurality of terminals having mounting tails. A pair of indicating devices mounted to the first connector each has conductive wires extending therefrom. Circuit traces are longitudinally arranged on the circuit board. First ends of the circuit traces are connected to the mounting tails while second ends of the circuit traces are connected to an intermediate device connected to a mother board. The circuit traces are arranged so that cross talk therebetween can be effectively reduced.

12 Claims, 4 Drawing Sheets

ELECTRICAL CONNECTOR ASSEMBLY

This application is a continuation-in-part of the copending application Ser. No. 09/295,969 filed Apr. 21, 1989.

BACKGROUND OF THE INVENTION

The present invention generally relates to an electrical connector assembly, and particularly to an electrical connector assembly having excellent shielding and grounding capabilities.

A connector assembly incorporating at least two stacked connectors is commonly used on a mother board for conserving occupied space thereon such as those disclosed in U.S. Pat. Nos. 5,501,613 and 5,733,143. Such a connector assembly includes a bracket for supporting the stacked connectors. Each connector has an insulative housing and a plurality of terminals retained in the housing. Each terminal has a mounting tail rearwardly extending beyond the housing for being soldered to the mother board. However, the exposed parts of the terminals are subject to external electromagnetic interference. Each terminal disposed at a high level of the connector assembly has a long vertical portion exposed outside of the housing and is more likely to be adversely affected by interference. In addition, without grounding means between terminals in different rows, cross talk therebetween hinders proper signal transmission. Thus, a connector assembly which can absolve the above problems is desired.

SUMMARY OF THE INVENTION

Accordingly, a first purpose of the present invention is to provide an electrical connector assembly which can effectively reduce cross talk between terminals in different rows.

A second purpose of the present invention is to provide an electrical connector assembly having a bracket defining a plurality of cavities for receiving at least two stacked connectors thereby promoting an efficient use of space on a mother board.

A third purpose of the present invention is to provide an electrical connector assembly having excellent shielding capabilities.

To fulfill the above-mentioned purposes, an electrical connector assembly in accordance with the present invention comprises a first connector, a pair of second connectors, a circuit board and a bracket. The first connector is located above the second connectors. The bracket defines a pair of vertically aligned cavities for receiving the first and second connectors. The first connector includes a plurality of terminals having mounting tails. A pair of indicating devices mounted to the first connector and each indicating device has conductive wires extending therefrom. Circuit traces are longitudinally arranged on the circuit board. First ends of the circuit traces are connected to the mounting tails while second ends of the circuits are connected to an intermediate device connected to a mother board. The circuit traces are arranged so that cross talk therebetween can be effectively reduced.

The connector assembly further comprises a pair of shielding shells for effectively shielding the terminals from external electromagnetic interference.

DETAILED DESCRIPTION OF THE PREFERRED EMBODIMENT

Figure 1:
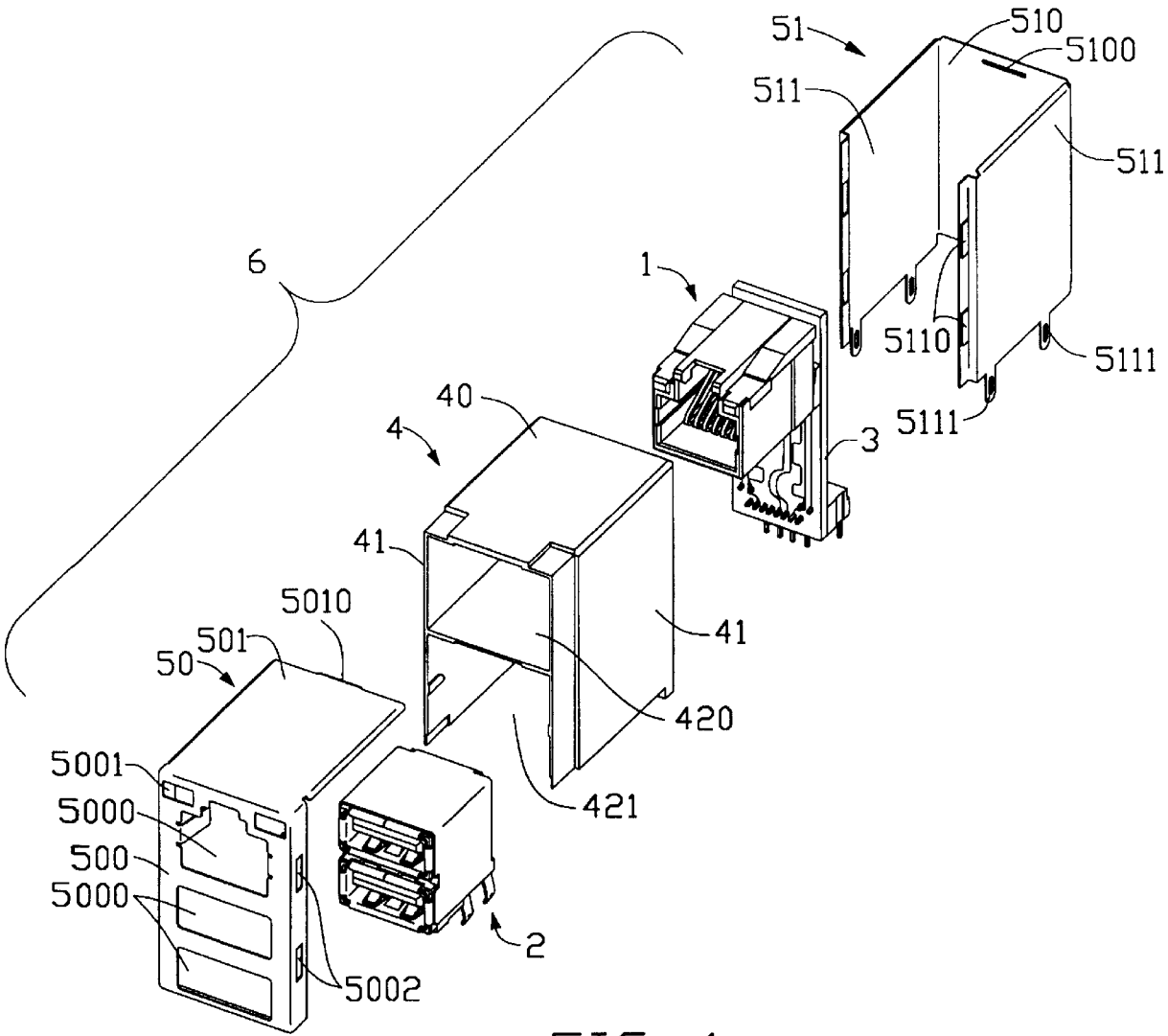
FIG. 1 is an exploded view of an electrical connector assembly in accordance with the present invention.
Figure 4:
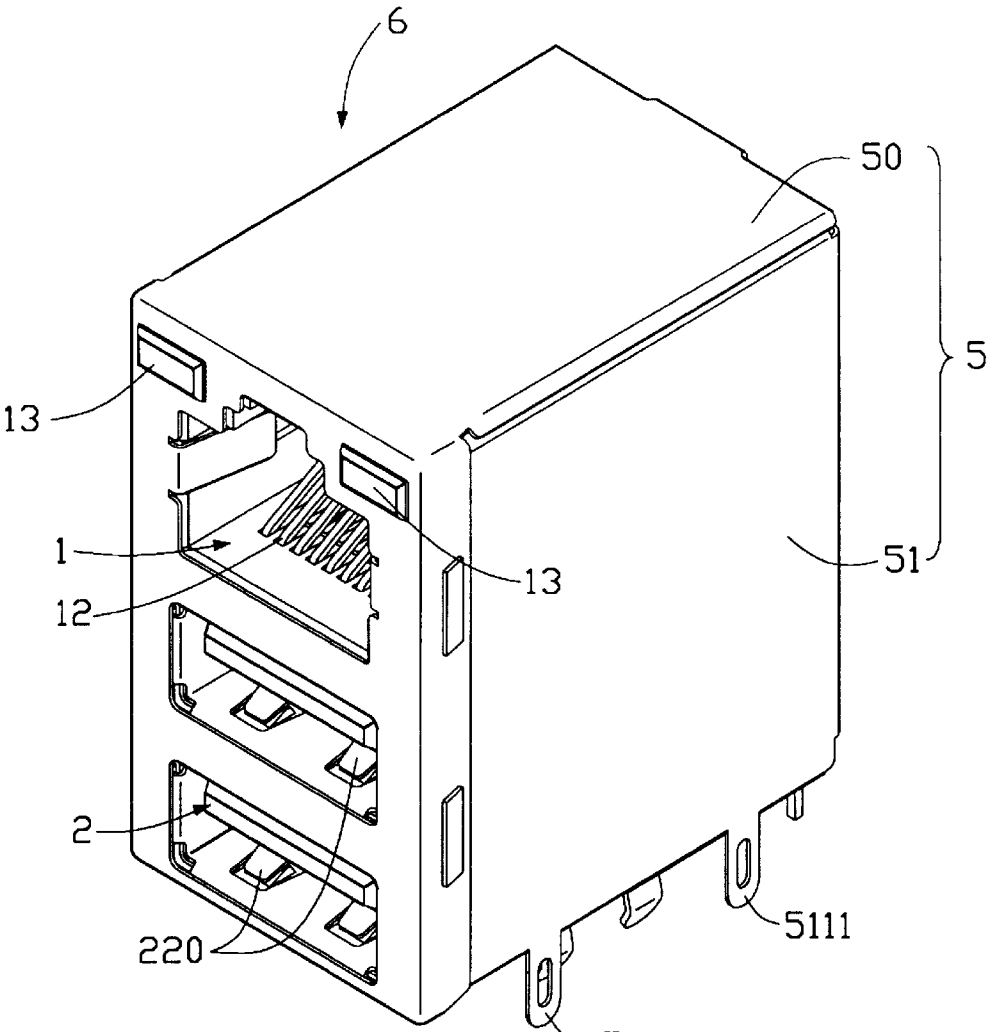
FIG. 4 is an assembled view of FIG. 1.

Referring to FIGS. 1 and 4, an electrical connector assembly 6 in accordance with the present invention comprises a bracket 4, a first connector 1, a pair of second connectors 2, a circuit board 3 and a shielding shell 5.

The bracket 4 defines an upper cavity 420 for receiving the first connector 1 and a lower cavity 421 for receiving the second connectors 2. The lower cavity 421 is exposed to a bottom of the bracket 4.

Figure 2:
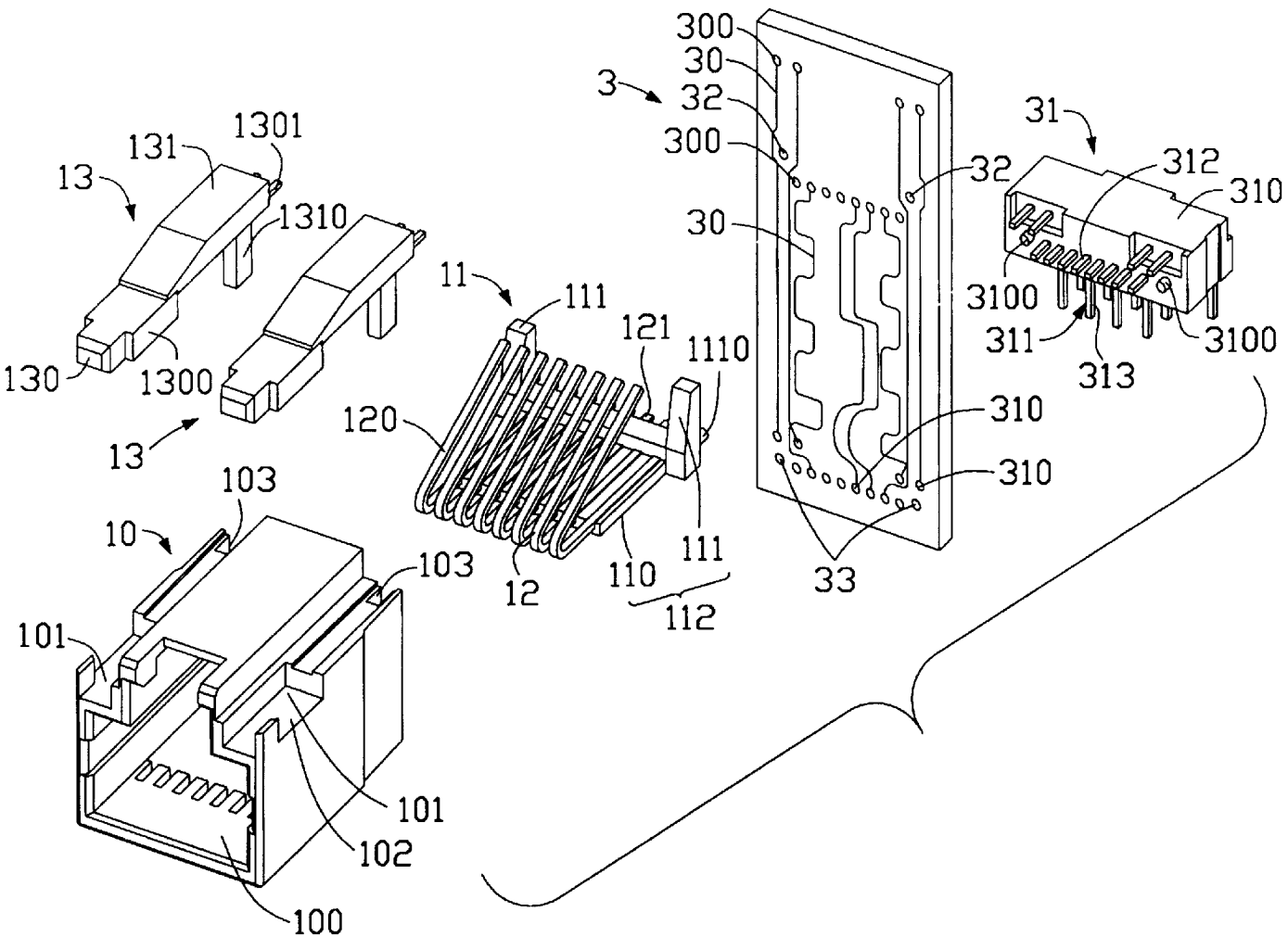
FIG. 2 is an exploded view of a first connector, a pair of indicating devices, a circuit board and an intermediate device.

Referring to FIG. 2, the first connector 1 in the present embodiment is a type of connector (RJ45) used in a telephone communication network. The first connector 1 includes an insulative first housing 10 defining a receiving cavity 100 and a terminal module 11 adapted to be received in the receiving cavity 100 from a rear portion of the first housing 10 for engaging with a first mating plug (not shown).

The terminal module 11 includes an insulative holder 112 and a row of conductive terminals 12. The holder 112 manufactured by insertion molding includes a retention plate 110 and a pair of elongate standoffs 111 perpendicular to the retention plate 110 and proximate opposite lateral edges of the retention plate 110. A guiding pin 1110 rearwardly extends from each standoff 111 for engaging an aperture 32 formed in the circuit board 3 thereby properly positioning the terminal module 11 thereon. A row of terminals 12 is retained in the retention plate 110. Each terminal 12 has a mating end 120 reversely bent for engaging with the first mating plug and a mounting tail 121 oppositely extending from the mating end 120 for engaging with the circuit board 3. The standoffs 111 are adapted to abut against the circuit board 3 thereby distancing the first housing 10 from the circuit board 3.

A pair of stepped retention grooves 101 is formed in a top surface of the first housing 10. A pair of cutouts 102 is formed in opposite side surfaces of the first housing 10 in communication with the corresponding retention groove 101. A vertical engaging groove 103 is defined in a rear surface of the first housing 10 proximate each retention groove 101.

The first connector 1 has a pair of indicating devices 13 adapted to be mounted to the first housing 10. Each indicating device 13 includes an elongate body 131 adapted to engage in the retention groove 101, an LED (light emitting diode) 130 and a pair of conductive wires 1301 connected to the LED 130 and extending beyond the body 131. A post 1310 downwardly projects from a bottom surface of the body 131 for insertion in the corresponding engaging groove 103 thereby securing the indicating device 13 to the first housing 10. A block 1300 extends from a side of each body 131 for being snugly received in the cutout 102 thereby preventing forward and rearward movement of the indicating device 13 relative to the first housing 10.

The wires 1301 of each indicating device 13 and the mounting tails 121 of the terminal module 11 are connected to the circuit board 3. The circuit board 3 is substantially rectangular. A plurality of circuit traces 30 is longitudinally arranged on opposite surfaces of the circuit board 3 and connected between corresponding upper holes 300 disposed proximate a top edge of the circuit board 3 and corresponding lower holes 310 disposed proximate a bottom edge of the circuit board 3. One of a pair of circuit traces is arranged on one side of the circuit board 3 while another of the pair of the circuit traces is arranged on another side of the circuit board 3. The pair of circuit traces intersects whereby a magnetic and electrical field generated by one circuit traces can neutralize a magnetic and electrical field generated by another circuit traces. Therefore, the cross talk between the circuit traces is effectively reduced.

The wires 1301 of each indicating device 13 and the mounting tails 121 of the terminal module 11 are inserted into the upper holes 300 and connected to the circuit traces 30. The circuit traces 30 are electrically connected to a mother board (not shown) through an intermediate device 31 inserted into the lower holes 310 of the circuit board 3.

The intermediate device 31 includes an elongate insulative body 310 and two rows of conductive L-shaped terminals 311 retained in the body 310. Each terminal 311 has a mating end 312 for insertion into the lower holes 310 of the circuit board 3 for being connected to the circuit tracks 30, and a solder tail 313 for being soldered to the mother board. A pair of guiding pins 3100 projects from a front face of the body 310 and engages with corresponding lower apertures 33 formed in the circuit board 3 for properly positioning the intermediate device 31 on the circuit board 3.

Figure 3:
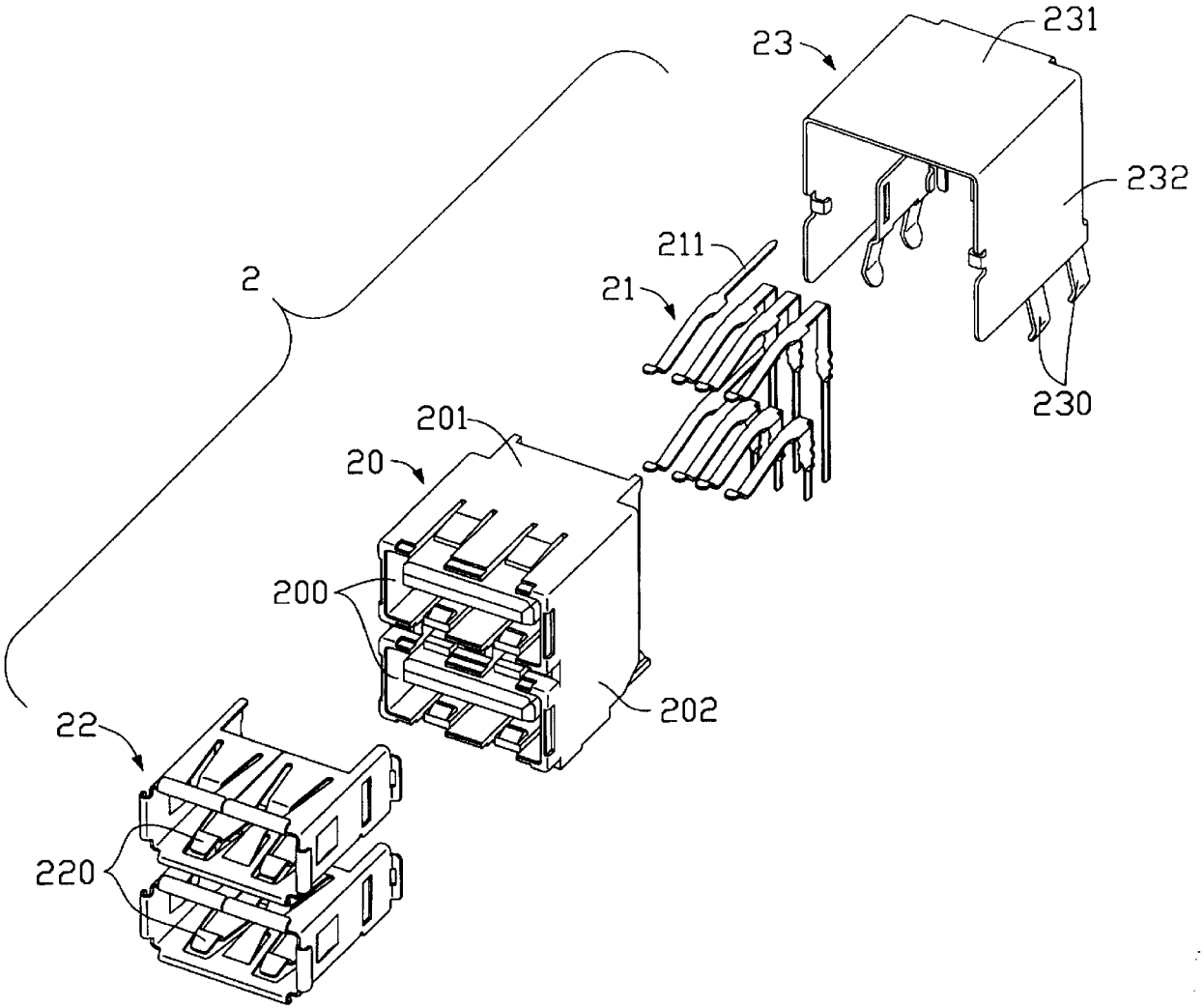
FIG. 3 is an exploded view of a pair of second connectors.

Referring to FIG. 3, the second connectors 2 are types of stacked USB (Universal Serial Bus) connectors. The second connectors 2 have an integral second housing 20. The second housing 20 defines a pair of vertically aligned cavities 200 between front and rear faces thereof. A plurality of second contacts 21, except of the second contact 211, is inserted from the rear face of the second housing 20 into the cavities 200 for engaging with corresponding second mating plugs (not shown). The second contact 211 rearwardly extends into a corresponding hole of the circuit board and is connected to circuit thereon. The function of the second contact 211 can be determined by a specific layout of the circuit on the circuit board 3. A pair of inner shielding enclosures 22 forming a plurality of grounding tabs 220 is respectively received in the cavities 200 for shielding the contacts 21 from external electromagnetic interference. A shielding shell 23 having a top wall 231 and a pair of lateral walls 232 is adapted to cover a top surface 201 and a pair of lateral surfaces 202 of the second housing 20 for shielding the contacts 21 from external electromagnetic interference. A pair of retention feet 230 is formed at a rear edge of each lateral wall 232 of the shielding shell 23 for being secured to the mother board and connected to a grounding path.

Referring to FIGS. 1 and 4, the first connector 1 is received in the upper cavity 420 while the second connectors 2 are received in the lower cavity 421 of the bracket 4. The shielding shell 5 includes a first shell 50 and a second shell 51. The first shell 50 includes a front member 500 for covering a front of the bracket 4 and a top member 501 perpendicular to the front member 500 for covering a top surface 40 of the bracket 4. Three openings 5000 are defined in the front member 500 for the extension of first and second plugs (not shown) therethrough to engage with the first and second connectors 1, 2. A pair of windows 5001 is defined in the front member 500 proximate the top member 501 for exposing the LEDs 130 of the indicating devices 13. A pair of engaging slits 5002 is defined proximate each lateral edge of the front member 500. A securing tab 5010 extends from a rear edge of the top member 501. The second shell 51 includes a rear member 510 for covering a rear portion of the bracket 4 and a pair of lateral members 511 perpendicularly extending from to the rear member 510 for covering a pair of lateral surfaces 41 of the bracket 4. A pair of engaging tab 5110 extends from a front edge of the lateral members 511 for engaging with the engaging slots 5002 of the first shell 50 thereby securing the first shell 50 and the second shell 51 together. An elongate slit 5100 is defined in the rear member 510 proximate a top edge thereof for engaging with the securing tab 5010 of the first shell 50 thereby further securing the first shell 50 and the second shell 51 together. A pair of securing feet 5111 extends from a bottom edge of each lateral member 511 for being secured to the mother board and connected to a grounding path.

The connector assembly 1 of the present invention has excellent shielding and grounding mechanisms for eliminating internal and external signal interference. In addition, the connectors 1, 2 can be easily received in or removed from the cavities 420, 421.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector assembly for mounting on a mother board, comprising:

a bracket defining an upper cavity and a lower cavity;

a first connector received in the upper cavity and including a first insulative housing, the first insulative housing including a receiving cavity and a terminal module accommodated in the receiving cavity, the terminal module including an insulative holder and a plurality of terminals retained in the holder, each terminal forming a rearwardly extending mounting tail;

a second connector received in the lower cavity and including a second insulative housing and a plurality of contacts retained in the second insulative housing;

a circuit board disposed at a rear of the bracket and including circuit traces on at least one side thereof and a plurality of holes, the circuit traces connecting to the holes, the holes receiving the mounting tails, the circuit traces being so arranged that one of a pair the of circuit traces is arranged on one side of the circuit board while another of the pair of circuit traces is arranged on another side of the circuit board, the pair of circuit traces being the mirror-image of each other whereby a magnetic and electrical field generated by one circuit trace neutralizes a magnetic and electrical field generated by the other of the pair, thus reducing cross talk therebetween; and an intermediate device connected between the circuit traces of the circuit board and the mother board; wherein the electrical connector further comprises an indicating device retained in the first insulative housing, the indicating device including a first insulative body, a light emitting device, and a pair of conductive wires connected to the light emitting device, the wires extending beyond the first insulative body and being connected to the circuit traces of the circuit board, the first insulative housing including a retention groove in a top surface thereof for retaining the indicating device therein, a cutout proximate the retention groove and a vertical groove at a rear of the retention groove, wherein the first insulative body of the indicating device includes a laterally extending block for engaging with the cutout and a downwardly extending post for engaging with the vertical groove thereby securing the indicating device to the first insulative housing.

2. The electrical connector assembly as claimed in claim 1, wherein a first guiding pin rearwardly projects from the holder of the terminal module, and wherein the circuit board includes an aperture, the first guiding pin being inserted into the aperture of the circuit board thereby properly positioning the first connector on the circuit board.

3. The electrical connector assembly as claimed in claim 1, wherein the intermediate device includes a second insulative body and a plurality of terminals retained in the second body, each terminal extending into a corresponding hole formed in the circuit board and connected to a corresponding circuit trace, the terminal being adopted for soldering to the mother board.

4. The electrical connector assembly as claimed in claim 3, wherein a second guiding pin forwardly projects from the second body, and wherein the circuit board includes an aperture, the second guiding pin being inserted into the aperture of the circuit board thereby properly positioning the intermediate device on the circuit board.

5. The electrical connector assembly as claimed in claim 1 further comprising a third connector assembled with the second connector and including a plurality of contacts, in the third connector assembly of the second and third connector being received in the second cavity.

6. The electrical connector assembly as claimed in claim 5, wherein the assembly of the second and third connectors further includes a shielding shell partly covering an outer surface thereof.

7. The electrical connector assembly as claimed in claim 5, wherein the second and third connectors each have a shielding enclosure disposed therein for shielding the contacts from external electromagnetic interference.

8. The electrical connector assembly as claimed in claim 1, further comprising a first shielding shell and a second shielding shell integrated together to partly cover outer surfaces of the bracket for shielding the terminals and the contacts from external electromagnetic interference.

9. The electrical connector assembly as claimed in claim 8, wherein the first shielding shell defines a pair of openings for exposing the first and second connectors thereby allowing a mating connector to engage therewith.

10. The electrical connector assembly as claimed in claim 8, wherein the first shielding shell includes a plurality of tabs, wherein the second shielding shell defines a plurality of slits, the tabs engaging the slits thereby securing the first and second shells together.

11. An electrical connector assembly for mounting on a mother board, comprising:

a bracket defining at least an upper cavity and a lower cavity;

a first connector received within the upper cavity and a second connector received within the lower cavity, respectively, the first connector including a plurality of first contacts and the second connector including a plurality of second contacts thereof; and a circuit board disposed on a rear portion of the bracket; wherein the second contacts are directly mounted to the mother board, while the first contacts are electrically connected to the mother board through said circuit board and an intermediate device intermediating between said circuit board and said mother board.

12. An electrical connector assembly for mounting to a mother board, comprising:

a first connector including a first insulative housing defining a receiving cavity, and a terminal module accommodated in said receiving cavity, said terminal module including an insulative holder binding a plurality of first terminals thereof;

a second connector positioned under said first connector, and including a second insulative housing with a plurality of second terminals therein, the second terminals being directly mounted to the mother board;

a circuit board positioned on rear portions of both the first and second connectors; and an intermediate device, disposed between the circuit board and the mother board, including an insulative body with a plurality of third terminals thereof; wherein said terminal module and said intermediate device are positioned on two opposite sides of the circuit board, and said terminals of said terminal module are positioned around a top portion of the circuit board and the first terminals of said terminal module are electrically connected to the mother board through the circuit board and the intermediate device while said intermediate device is positioned around a bottom portion of the circuit board.

* * * * *